US008433208B2

(12) United States Patent
Nanayama

(10) Patent No.: US 8,433,208 B2
(45) Date of Patent: Apr. 30, 2013

(54) IMAGE FORMING APPARATUS THAT ONLY PROMPTS AN INSPECTION REQUEST AFTER A PREDETERMINED NUMBER OF FAILURES OF A ROTARY GUIDE MEMBER

(75) Inventor: Daisuke Nanayama, Osaka (JP)

(73) Assignee: Kyocera Mita Corporation (JP)

( * ) Notice: Subject to any disclaimer, the term of this patent is extended or adjusted under 35 U.S.C. 154(b) by 354 days.

(21) Appl. No.: 12/795,067

(22) Filed: Jun. 7, 2010

(65) Prior Publication Data

US 2010/0310262 A1 Dec. 9, 2010

(30) Foreign Application Priority Data

Jun. 9, 2009 (JP) ..... 2009-138179

(51) Int. Cl.
*G03G 15/00* (2006.01)

(52) U.S. Cl.
USPC ..... 399/10; 399/21

(58) Field of Classification Search ..... 399/9, 10, 399/21, 401, 405; 271/65, 279, 301, 291, 271/298, 302, 303; 400/642
See application file for complete search history.

(56) References Cited

U.S. PATENT DOCUMENTS 4,251,000 A * 2/1981 Templeton ..... 209/547
4,925,178 A * 5/1990 Clabbers et al. ..... 271/186
5,868,387 A 2/1999 Kida et al.
5,927,713 A * 7/1999 Driscoll et al. ..... 271/298
7,887,054 B2 * 2/2011 Daigo et al. ..... 271/303
2005/0232672 A1 * 10/2005 Nakamura et al. ..... 399/405
2006/0143286 A1 * 6/2006 Aoki et al. ..... 709/220
2008/0292330 A1 * 11/2008 Kabashima et al. ..... 399/21
2009/0243199 A1 * 10/2009 Daigo et al. ..... 271/225
2009/0267291 A1 * 10/2009 Tabata ..... 271/225

FOREIGN PATENT DOCUMENTS

JP 9-86759 3/1997

* cited by examiner

*Primary Examiner* — Judy Nguyen
*Assistant Examiner* — Blake A Tankersley
(74) *Attorney, Agent, or Firm* — Gerald E. Hespos; Michael J. Porco; Matthew T. Hespos

(57) ABSTRACT

An image forming apparatus has a rotary guide including a path for a sheet being conveyed. The guide is rotatable so that an exit of the path faces one of at least two conveyance destinations. A motor rotates the guide, and a detector outputs a detection signal when a predetermined posture of the guide is detected. An instructing section outputs instruction signals to the motor to rotate the guide toward the predetermined posture. A judging section judges whether a detection signal has been received in response to the instruction signal, and a notifying section counts a consecutive occurrence number of a judgment result to the effect that no detection signal was received in response to the instruction signal this time and gives a notification prompting an inspection request of the image forming apparatus when the consecutive occurrence number reaches a set number.

9 Claims, 9 Drawing Sheets

IMAGE FORMING APPARATUS THAT ONLY PROMPTS AN INSPECTION REQUEST AFTER A PREDETERMINED NUMBER OF FAILURES OF A ROTARY GUIDE MEMBER

BACKGROUND OF THE INVENTION

1. Field of the Invention

The present invention relates to an image forming apparatus provided with a sheet conveying direction switching mechanism for switching a conveying direction of a sheet being conveyed.

2. Description of the Related Art

Conventionally, there has been known a sheet conveying direction switching device used in a sheet conveyor system of an image forming apparatus. For example, a device for switching a conveyance destination of a sheet having a toner image formed on a surface upon the completion of an image forming process between a discharge tray and a switchback conveyance path for a two-sided printing process is known as such a sheet conveying direction switching device. Such a sheet conveying direction switching device includes a rotary guide member disposed at a diverging point to discharge destinations for switching the conveyance destination of the sheet.

This rotary guide member is composed of a pair of circular side plates arranged to face at a distance slightly longer than the width of the sheet, four guide plates extending between these circular side plates and rotary shafts each projecting from the corresponding circular side plate. The rotary guide member is rotatable about the rotary shafts. Different guide paths (straight guide path in the center and reversing guide paths at the opposite sides) are defined between the respective guide plates. Which of the guide paths the sheet conveyed to the rotary guide member passes is determined based on a rotation amount from a reference phase (rotational position as a reference) of the rotary guide member. According to the guide path along which the sheet passes, the sheet is discharged to the preset conveyance destination.

Such a rotary guide member is driven and rotated about the rotary shafts by a stepping motor which is driven and rotated according to a pulse number of a pulse signal. In this way, the posture of the rotary guide member is set (i.e. the conveyance destination of the sheet being conveyed is set).

The stepping motor rotates only by an angle corresponding to the pulse number of the pulse signal from the present position. Thus, the rotary guide member is first set in a preset reference posture and, in this state where the rotary guide member is set in the reference posture, the stepping motor is rotated, for example, by a pulse signal having a pulse number corresponding to the discharge tray or by a pulse signal having a pulse number corresponding to a switchback conveyance path, whereby the rotary guide member can be set (positioned) in the reference posture (rotational position) determined beforehand according to the conveyance destination. Thus, the image forming apparatus of this type normally includes a reference posture detection sensor for detecting that the rotary guide member has reached the reference posture in order to position the rotary guide member in the reference posture.

On the other hand, there has been conventionally provided no means (sensor) for directly detecting an abnormality of the motor for driving the rotary guide member. Thus, an abnormality is indirectly judged to have occurred in the motor if the rotary guide member was not rotated and no detection signal was output from the reference posture detection sensor even through an instruction was given to drive and rotate the rotary guide member.

In this way, the abnormality of the motor was judged when the rotary guide member was not rotated. Thus, an abnormally was judged to have occurred in the stepping motor and a notification was given to inform the abnormality of the stepping motor and prompt an inspection request to a service person not only when the abnormality occurred in the stepping motor itself, but also when the rotation of the rotary guide member was hindered, for example, by a mere sheet jam.

However, there are causes of abnormalities that can be dealt with by a user himself without requiring the service person to inspect. One example is a case where the rotation of the rotary guide member is hindered by a sheet jam. If the user contacts the service person and lets him to deal with a problem although this problem can be dealt with by the user himself, it increases burdens on a party in charge of apparatus maintenance and is not also preferable to the user since the user cannot use the image forming apparatus until a problem solving operation by the service person is completed.

SUMMARY OF THE INVENTION

An object of the present invention is to provide an image forming apparatus capable of maximally reducing the number of operations by a service person upon the occurrence of a problem that no detection signal is output from a reference posture detection sensor for detecting that a rotary guide member has reached a reference posture (has been positioned at a reference position).

One aspect of the present invention is directed to an image forming apparatus, comprising a rotary guide member including a guide path capable of permitting the passage of a sheet being conveyed and rotatable about a supporting shaft extending in a direction orthogonal to a conveying direction to change the posture thereof in such a manner that the exit of the guide path faces toward any one of at least two conveyance destinations; a motor for changing the posture of the rotary guide member; a detector for outputting a detection signal when a predetermined posture of the rotary guide member is detected; an instructing section for outputting an instruction signal to the motor to operate the rotary guide member toward the predetermined posture when a predetermined operation which triggers the start of a process for confirming the operation of the rotary guide member using the detector is performed to the image forming apparatus; a judging section for judging whether or not the detection signal has been received from the detector in response to the instruction signal by the instructing section this time; and a notifying section for counting a consecutive occurrence number of a judgment result to the effect that no detection signal was received in response to the instruction signal this time when the judging section judged that no detection signal was received in response to the instruction signal this time and giving at least one of a notification prompting an inspection request of the image forming apparatus and a notification relating to prompting of the inspection request when the consecutive occurrence number reaches a set plural number.

These and other objects, features and advantages of the present invention will become more apparent upon reading the following detailed description along with the accompanying drawings.

BRIEF DESCRIPTION OF THE DRAWINGS

FIG. 5 is a section along V-V of the conveying direction switching portion shown in FIG. 3, FIG. 6 are front views in section showing sheet guiding postures of a rotary guide member, wherein FIG. 6A shows a state where the rotary guide member is set in a reference posture and FIG. 6B is set in a standing posture, FIG. 7 are front views in section showing sheet guiding postures of the rotary guide member, wherein

DETAILED DESCRIPTION OF THE PREFERRED EMBODIMENTS

Figure 1:
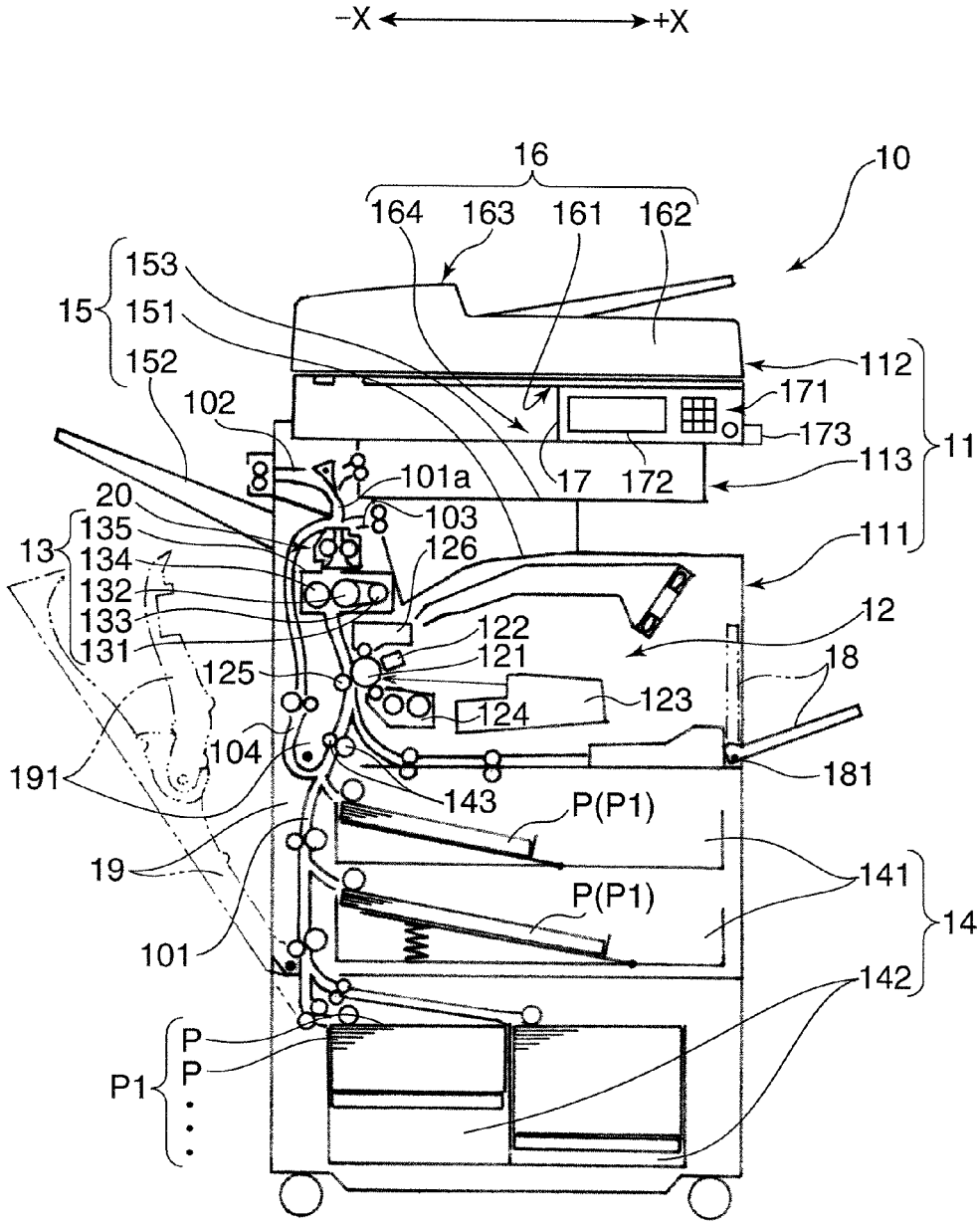
FIG. 1 is a front view in section outlining one embodiment of an image forming apparatus according to the invention.
Figure 2:
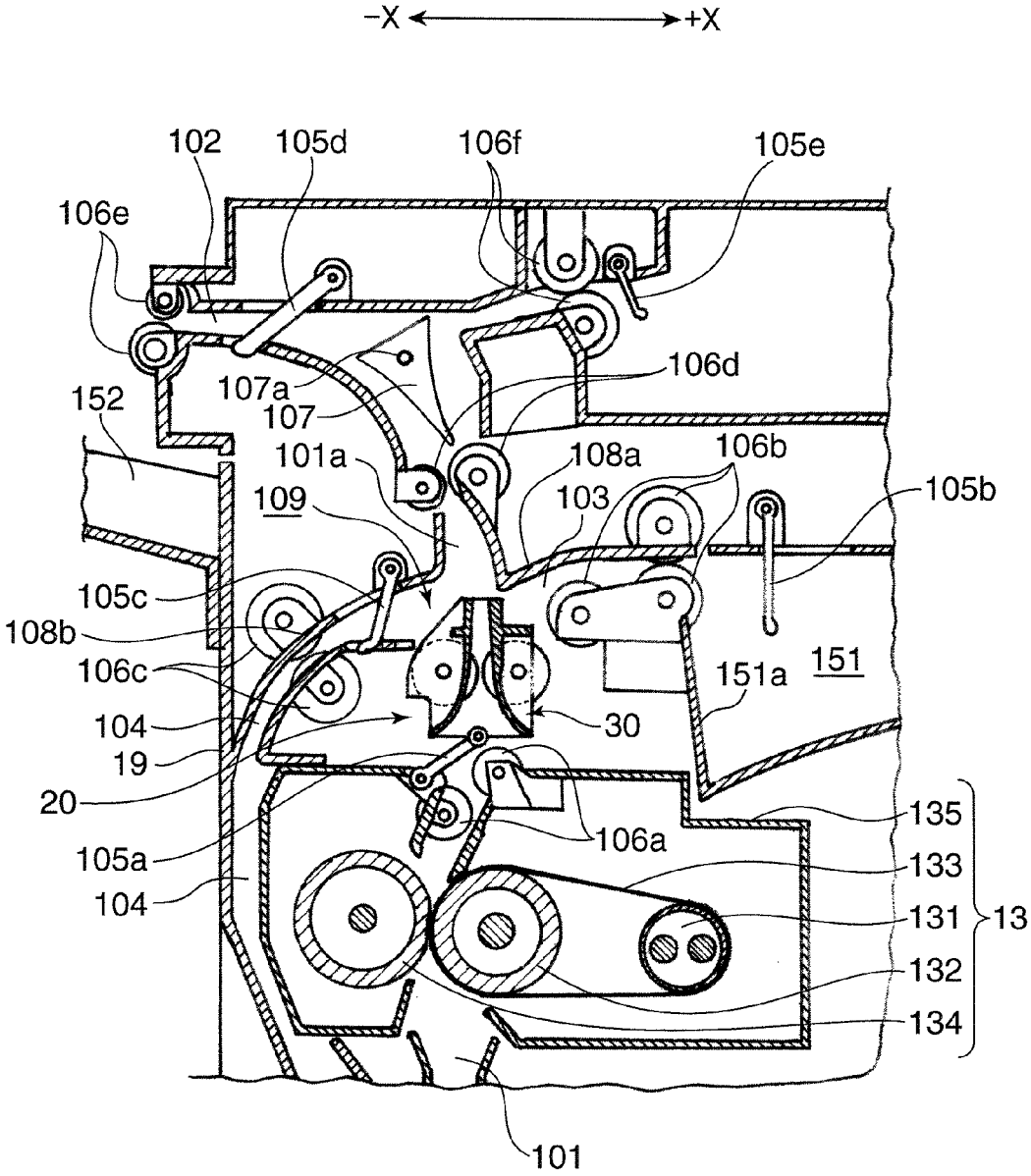
FIG. 2 is an enlarged diagram showing a mechanical part of a conveying direction switching device formed in an apparatus main body of the image forming apparatus shown in FIG. 1.

Hereinafter, one embodiment of an image forming apparatus according to the present invention is described with reference to the drawings. In the respective drawings, constructions identified by the same reference numerals are the same constructions and not repeatedly described. FIG. 1 is a front view in section showing an exemplary construction of an image forming apparatus 10 according to the present invention, and FIG. 2 is an enlarged diagram showing a conveying direction switching portion 109 as a mechanical part of a conveying direction switching device 20 shown in FIG. 1 and its periphery. The conveying direction switching portion 109 is formed in an apparatus main body 11 of the image forming apparatus 10. In FIGS. 1 and 2, X-X directions are referred to as lateral directions, particularly −X direction being a leftward direction and +X direction being a rightward direction.

The image forming apparatus 10 shown in FIG. 1 is a copier of the so-called internal discharge type and provided with the apparatus main body 11, an image forming unit 12, a fixing unit 13, a sheet storing unit 14, a discharge unit 15, an image reading unit 16 and an operation unit 17. A part (internal discharge tray 151 to be described later) of the discharge unit 15 is formed by denting a part of the apparatus main body 11 below the image reading unit 16. Thus, this image forming apparatus 10 is called to be of the internal discharge type.

The apparatus main body 11 includes a lower main body 111 having a rectangular parallelepipedic outer shape, an upper main body 112 having a flat rectangular parallelepipedic outer shape arranged to face the lower main body 111 from above, and a connecting part 113 disposed between these upper main body 112 and lower main body 111. The connecting part 113 is a structure for connecting the lower and upper main bodies 111, 112 with each other with the internal discharge tray 151 of the discharge unit 15 formed between the lower and upper main bodies 111, 112.

The image forming unit 12, the fixing unit 13 and the sheet storing unit 14 are housed in the lower main body 111, and the image reading unit 16 is mounted in the upper main body 112. The operation unit 17 is provided on a front edge part of the upper main body 112.

The operation unit 17 is for receiving operation inputs relating to an image forming process and includes a numerical pad used to input the number of sheets P to be processed, various operation keys 171, a touch panel 172 including an LCD (Liquid Crystal Display) used for touch input, a power button 173 used to turn on and off power supply required by the respective parts of the image forming apparatus 1, etc.

The operation unit 17 also receives type information of sheets P indicating whether the sheets P stored in or on sheet storage units such as the sheet storing unit 14 and a manual feed tray 18 are ordinary sheets, thick sheets or transparent resin sheets such as those for OHP (OverHead Projector). In the following description, sheet members other than paper sheets such as OHP sheets are also written as sheets P.

The sheet storing unit 14 includes sheet cassettes 141 detachably insertable at positions right below the image forming unit 12 in the lower main body 111 and large capacity decks 142 detachably insertable at a position below the sheet cassettes 141 and capable of storing a large number of sheets P. In this embodiment, two sheet cassettes 141 are arranged one above the other and two large capacity decks 142 are arranged side by side.

Upon performing the image forming process, sheets P are dispensed one by one from a sheet stack P1 stored in the sheet cassette 141 or large capacity deck 142 and fed to the image forming unit 12 to have the image forming process (printing process) performed thereto.

The discharge unit 15 includes the internal discharge tray (first discharge tray; switchback tray) 151 formed between the lower and upper main bodies 111, 112, an external discharge tray (second discharge tray) 152 formed outside the apparatus main body 11 and an internal finisher 153 provided at a position right above the internal discharge tray 151. A sheet having a toner image already transferred thereto and conveyed from the image forming unit 12 to the conveying direction switching portion 109 provided in the connecting part 113 via the fixing unit 13 is discharged to any one of the internal discharge tray 151, the external discharge tray 152 and the internal finisher 153 set as discharge destinations beforehand by the conveying direction switching portion 109. The internal finisher 153 is for performing post-processing such as punching or stapling to the discharged sheets P.

The internal discharge tray 151 is also used as a switchback tray (switchback portion) for turning sheets P, one side of each of which is completed with the printing process, upside down to perform the printing process also to the other side upon performing a two-sided printing process to the sheet P in addition to being simply used to discharge sheets P. In other words, the sheets P each completed with the printing process on one side thereof are switched back with the last one in the lead and returned to the image forming unit 12 after being temporarily discharged to the internal discharge tray 151. The sheets P completed with one-sided printing have the printing process performed to the other sides in the image forming unit 12 and are discharged to the internal discharge tray 151 or the external discharge tray 152.

The image reading unit 16 includes a contact glass 161 mounted in an upper opening of the upper main body 112 and used to place a document, an openable and closable document pressing cover 162 for pressing the document placed on the contact glass 161, an automatic document reader 163 mounted in the document pressing cover 162 and a scanning mechanism 164 for scanning an image of the document placed on the contact glass 161.

An image of a document placed on the contact glass 161 or fed onto the contact glass 161 by the automatic document feeder 163 is converted into a digital signal and output to an exposure unit 123 to be described later for the image forming process after being read as analog information by the scanning mechanism 164.

The manual feed tray 18 is provided at a position right above the sheet storing unit 14 on the right surface of the lower main body 111. This manual feed tray 18 has its bottom part supported rotatably about a supporting shaft 181 and is displaceable between a closing posture in which it stands to close a manual feed port and an opening posture in which it projects rightward. With such a manual feed tray 18 set in the opening posture, sheets P are manually fed one by one. The sheets P manually fed from such a manual feed tray 18 are fed toward a nip between a photoconductive drum 121 and a transfer roller 125 to be described later via a vertical sheet conveyance path 101 (main conveyance path).

An openable and closable maintenance door 19 (opening door) is provided on the left surface of the lower main body 111. The external discharge tray 152 is provided at a position above this maintenance door 19. A sheet P completed with the printing process in the image forming unit 12 is selectively discharged to either one of this external discharge tray 152 and the internal discharge tray 151.

The photoconductive drum 121 is arranged at a left position in a substantially vertical middle part of the image forming unit 12. This photoconductive drum 121 is rotated clockwise about a drum center. The photoconductive drum 121 has the circumferential surface thereof uniformly charged by a charger unit 122 arranged immediately to the right while being rotated.

The exposure unit 123 for irradiating the circumferential surface of the photoconductive drum 121 with a laser beam based on image information of a document image read by the image reading unit 16 is arranged to the right of the photoconductive drum 121. An electrostatic latent image is formed on the circumferential surface of the photoconductive drum 121 by the irradiation of the laser beam from this exposure unit 123. Toner is supplied toward this electrostatic latent image from a developing unit 124 arranged below the photoconductive drum 121, whereby a toner image in conformity with the electrostatic latent image is formed on the circumferential surface of the photoconductive drum 121.

A sheet P is conveyed upward from the sheet cassette 141 or the large capacity deck 142 along the vertically extending vertical sheet conveyance path 101 to be fed to the photoconductive drum 121 having a toner image formed thereon via a pair of registration rollers 143 for adjusting timing. The sheet P having reached the photoconductive drum 121 has the toner image on the circumferential surface of the photoconductive drum 121 transferred thereto by the action of the transfer roller 125 arranged to the left of the photoconductive drum 121 and facing the photoconductive drum 121. The sheet P having the toner image transferred thereto is separated from the photoconductive drum 121 and conveyed to the fixing unit 13.

The photoconductive drum 121 completed with a process of transferring the toner image to the sheet P continues to be rotated clockwise, whereby the circumferential surface thereof is cleaned by a cleaning device 126 arranged right above the photoconductive drum 121 and heads for the charging unit 122 for the next image forming process.

The fixing unit 13 includes a heating roller 131 internally provided with a heating element such as a halogen lamp, a fixing roller 132 arranged at the left side and facing the heating roller 131, a fixing belt 133 mounted between the fixing roller 132 and the heating roller 131 and a pressure roller 134 arranged at the left side and facing the outer surface of the fixing belt 133. The sheet P conveyed from the image forming unit 12 to the fixing unit 13 receives heat of the heating roller 131 via the fixing belt 133 while passing a nip between the fixing belt 133 and the pressure roller 134, whereby the toner image is fixed to the sheet P.

The sheet P after the fixing process has the conveyance destination thereof switched by the conveying direction switching portion 109 above the fixing unit 13 to be discharged to the external discharge tray 152 via a discharge conveyance path 102 (second auxiliary conveyance path) or to the internal discharge tray 151 via a reciprocating conveyance path 103 (first auxiliary conveyance path) when the sheet P is for one-sided printing, and is temporarily discharged to the internal discharge tray 151 (switchback portion), which doubles as a switchback tray, via the reciprocating conveyance path 103 (third auxiliary conveyance path) for two-sided printing.

In the case of two-sided printing, the sheet P completed with the printing process on one side has the front half thereof discharged to the internal discharge tray 151 via the reciprocating conveyance path 103. Then, this sheet P is conveyed in a reverse direction via a vertically extending reversing conveyance path 104 provided in the maintenance door 19 and fed to the image forming unit 12 again to have the printing process performed to the other side while being turned upside down. The sheet P completed with two-sided printing is discharged to the internal discharge tray 151 or the external discharge tray 152.

The maintenance door 19 includes a cover member 191 which is provided immediately to the right of the reversing conveyance path 104 and the right surface of which faces the left surface of the image forming unit 12. This cover member 191 is mounted on the right surface of the maintenance door 19. With the maintenance door 19 closed, a part of the vertical sheet conveyance path 101 for conveying sheets P fed from the sheet cassettes 141, the large capacity decks 142 and also the manual feed tray 18 is formed between the right surface of the cover member 191 and the left surface of the image forming unit 12.

As shown in FIG. 2, the conveying direction switching portion 109 is set in a space right above a housing 135 of the fixing unit 13 and to the left of a left wall 151*a* of the internal discharge tray 151. A first arcuate guide plate 108*a* having a curved surface concave downward and extending into the internal discharge tray 151 beyond the upper edge of the left wall 151*a* of the internal discharge tray 151 is disposed to the right and above the conveying direction switching portion 109. Further, a second arcuate guide plate 108*b* concave downward to convey the sheet P toward the revering conveyance path 104 located below at the left side of the fixing unit 13 is disposed to the left and above the conveying direction switching portion 109.

Between the left end of the first arcuate guide plate 108*a* and the right end of the second arcuate guide plate 108*b*, a clearance is formed to receive the sheet P discharged upward from the fixing unit 13 via the conveying direction switching portion 109. An upper-end conveyance path 101*a* as a part of the vertically extending vertical sheet conveyance path 101 is formed above this clearance.

A switching guide member 107 having a substantially isosceles triangular shape is disposed right above this upper-end conveyance path 101*a*. This switching guide member 107 is for switching the discharge destination of the sheet P fed from the upper-end conveyance path 101*a* between the internal finisher 153 and the external discharge tray 152 and is so postured that a part corresponding to a vertex of the isosceles triangular shape faces downward.

Such a switching guide member 107 is displaceable between a finisher posture for guiding the sheet P to the internal finisher 153 along the right surface by being rotated clockwise about a guide shaft 107*a* supporting the switching guide member 107 substantially at a center-of-gravity position and an external-discharge-tray posture for guiding the sheet P to the external discharge tray 152 along the left surface by being rotated counterclockwise about the guide shaft 107*a*.

In other words, sheets completed with the image forming process in the image forming unit 12 and the fixing process in the fixing unit 13 are discharged to the respective discharge destinations according to the purpose after being temporarily guided to the conveying direction switching portion 109. The conveying direction switching portion 109 includes a rotary guide member 30 instead of a conventional triangular switching guide.

A plurality of conveyor rollers are arranged around this rotary guide member 30, and a sheet P is smoothly taken in and out of the rotary guide member 30 by these conveyor rollers. Such conveyor rollers include fixing-unit exit rollers 106*a* arranged at an exit position of the fixing unit 13 and right before (right below) the rotary guide member 30, first discharge rollers 106*b* arranged below the first arcuate guide plate 108*a* (i.e. in the reciprocating conveyance path 103) and right before the internal discharge tray 151 for discharging the sheet P to the internal discharge tray 151, reversing-conveyance-path conveyor rollers 106*c* arranged below the second arcuate guide plate 108*b* for conveying the sheet toward the reversing conveyance path 104, switching-guide-member conveyor rollers 106*d* arranged right below the switching guide member 107 at the downstream end of the upper-end conveyance path 101*a* for conveying the sheet P toward the switching guide member 107, second discharge rollers 106*e* arranged at the upstream end of the external discharge tray 152 and third discharge rollers 106*f* arranged at the entrance of the internal finisher 153.

Various sheet sensors are arranged around the rotary guide member 30 to detect a state of conveyance of the sheet P via the rotary guide member 30. Such sheet sensors include a fixing sensor 105*a* (leading end take-in timing obtaining portion) arranged at the downstream end of the fixing unit 13 (on the upper part of the housing of the fixing unit 13), a first discharge sensor 105*b* disposed at the entrance of the internal discharge tray 151, a reverse-feed sensor 105*c* disposed at an upstream end position of the reversing conveyance path 104, a second discharge sensor 105*d* arranged near the second discharge rollers 106*e* at the upstream end of the external discharge tray 152 and a third discharge sensor 105*e* arranged near the third discharge rollers 106*f* at the entrance of the internal finisher 153.

The sheet P fed from the fixing unit 13 is conveyed toward a specified position by the detection of the sheet P by these sensors and preset operations of the conveying direction switching portion 109 and the switching guide member 107 based on these detection results.

Figure 3:
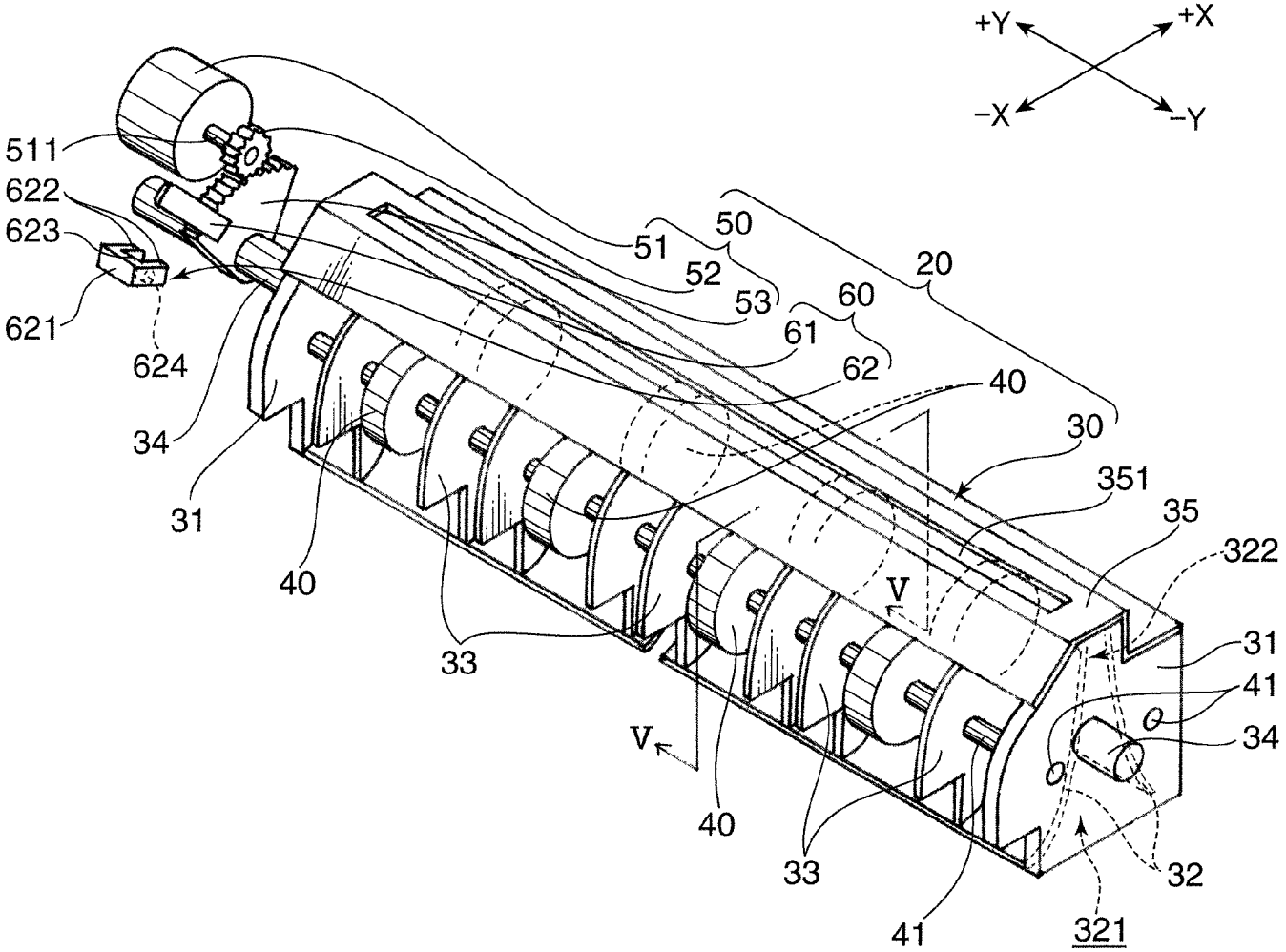
FIG. 3 is a perspective view partly cut away showing a state of one embodiment of a conveying direction switching portion shown in FIG. 2 when viewed obliquely from above.
Figure 4:
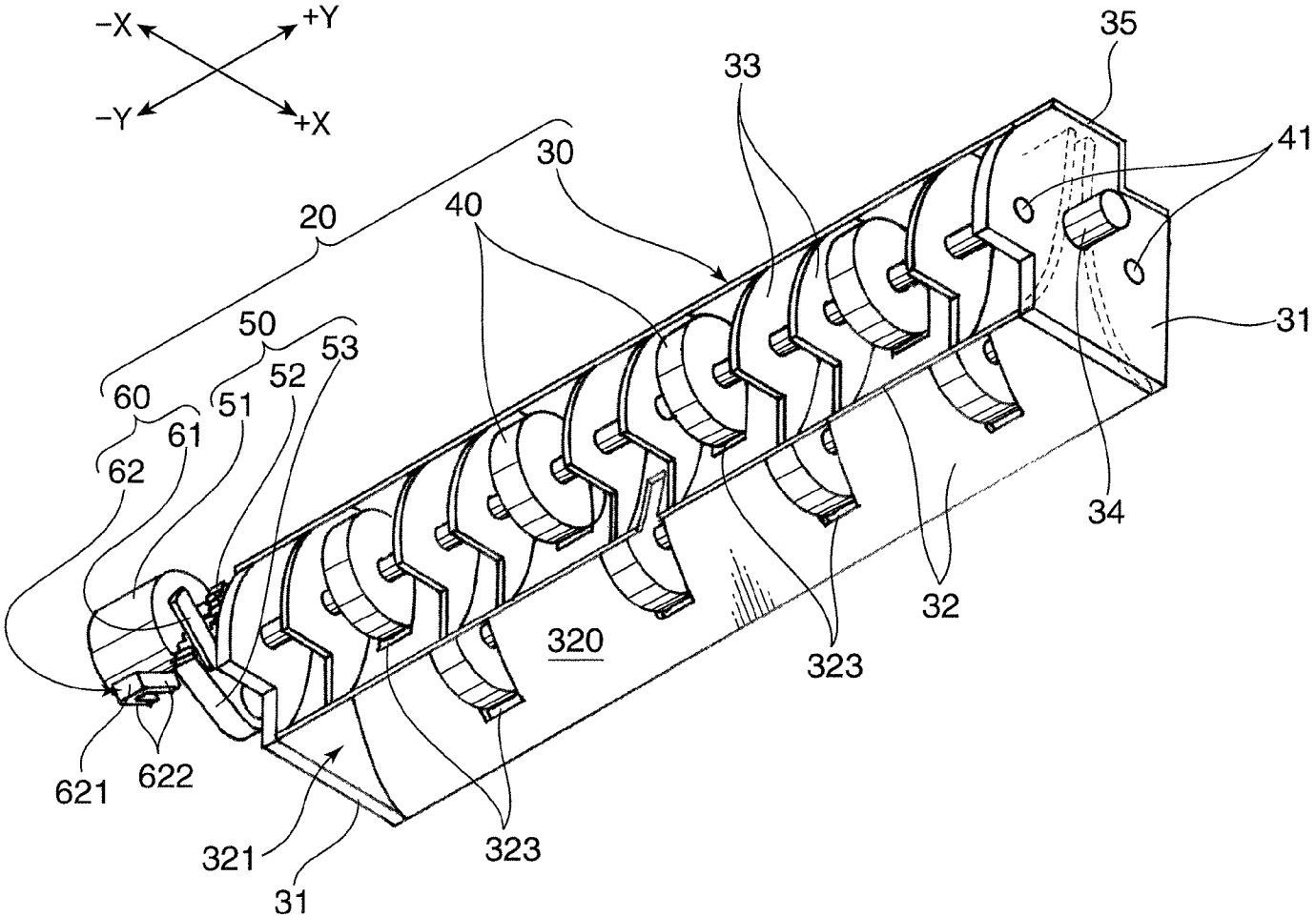
FIG. 4 is a perspective view showing the state of the conveying direction switching portion shown in FIG. 3 when viewed obliquely from below.
Figure 5:
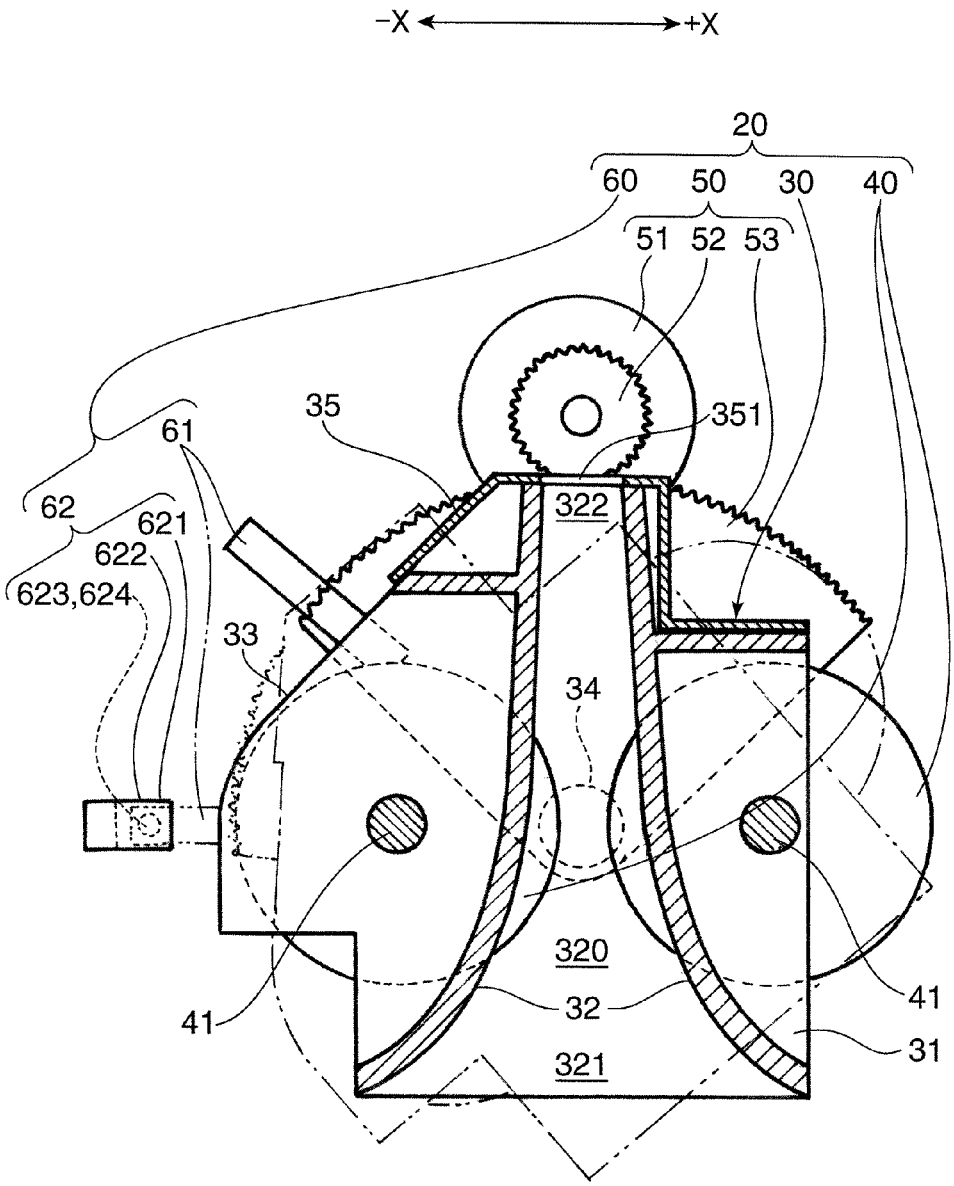

The conveying direction switching portion 109 is described below with reference to FIGS. 3 to 5. FIGS. 3 and 4 are perspective views partly cut away showing one embodiment of the conveying direction switching portion 109, wherein FIG. 3 shows a state viewed obliquely from above, i.e. viewed from an exit side for the sheet P and FIG. 4 shows a state viewed obliquely from below, i.e. viewed from an entrance side for the sheet P. FIG. 5 is a section along V-V of the conveying direction switching portion 109 shown in FIG. 3. In FIG. 5, a state where the rotary guide member 30 is set in a reference posture S1 (reference rotational position) is shown by chain double-dashed line and a state where the rotary guide member 30 is set in a standing posture S2 is shown by solid line. In FIGS. 3 to 5, X directions and Y directions are referred to as lateral directions and forward and backward directions and, particularly, −X, +X, −Y and +Y directions are respectively referred to as leftward, rightward, forward and backward directions.

First, as shown in FIG. 3, the conveying direction switching portion 109 includes the rotary guide member 30 for receiving a sheet P fed from the fixing unit 13 (FIG. 2) via the fixing-unit exit rollers 106*a* and guiding this sheet P to be discharged to a specified position set beforehand, guide pulleys 40 attached to this rotary guide member 30 for guiding the sheet P in such a manner as not to adversely affect a toner image formed on the sheet P, a posture changer 50 for changing the posture of the rotary guide member 30 by rotating the rotary guide member 30 in forward and reverse directions about specified guide shafts (supporting shaft) 34, and a reference position detector 60 for detecting that the rotary guide member 30 is located at the reference rotational position.

The rotary guide member 30 includes a pair of side plates 31 facing in forward and backward directions, a pair of arcuate guide plates 32 mounted between the respective side plates 31 and facing in lateral directions, a plurality of guide fins 33 fixed to the left arcuate guide plate 32 while being arranged side by side to face in forward and backward directions, a pair of front and rear guide shafts 34 projecting concentrically in opposite directions from substantially center-of-gravity positions of the front and rear side plates 31, and a cover body 35 mounted between the upper edges of the pair of side plates 31.

Each side plate 31 is formed by setting a substantially square basic shape when viewed from front and then deforming some parts of the square shape. By mounting the left and right arcuate guide plates 32 between this pair of side plates 31, the pair of arcuate guide plates 32 function as structural members and the rotary guide member 30 is formed to be structurally strong.

The pair of arcuate guide plates 32 are so formed that facing surfaces arcuately bulge out in opposite directions when viewed from front. Such a pair of arcuate guide plates 32 are so set that an interval (lateral distance) between them is widest at their bottom ends and gradually reduced toward the upper ends. A guide path 320 for guiding the sheet P fed from the fixing unit 13 is formed between the arcuate guide plates 32.

In other words, the pair of arcuate guide plates 32 are arranged to face at a distance and form one guide path 320 for guiding the sheet P fed from the fixing unit 13. The arcuate guide plates 32 include arcuate surfaces extending in an extending direction of this guide path 320. As a result of including such arcuate surfaces, the distance between the arcuate guide plates 32 is wide between the bottom edges and gradually reduced toward the upper ends when viewed from front.

The interval between the bottom edges (bottom end opening side) of the pair of arcuate guide plates 32 serves as a receiving opening 321 (entrance) for receiving the sheet P discharged from the fixing unit 13 and the interval between the upper edges (upper end opening side) serves as a discharge opening 322 (exit) for discharging the sheet P. The sheet P discharged from the fixing unit 13 is introduced to between the pair of arcuate guide plates 32 from the receiving opening 321 via a detection position of the fixing sensor 105*a* and discharged upward via the discharge opening 322 and a later-described discharge port 351 (exit) formed in the cover body 35. The destination of the sheet P discharged from the discharge port 351 through the guide path 320 of the rotary guide member 30 is predetermined depending on the posture of the rotary guide member 30. This is described in detail later.

The guide fins 33 receive and guide the sheet P being conveyed toward the reversing conveyance path 104 from the internal discharge tray 151 where the sheet P was temporarily stored with the rotary guide member 30 set in a reversing-conveyance-path posture S4 (see FIG. 7B) to be described later. At this time, the sheet P is the one for two-sided printing, to the other side of which the printing process should be performed. The upper end surfaces (guide surfaces) of such guide fins 33 are formed to have arcuate shapes convex upward similar to the upper end surfaces of the side plates 31 with the rotary guide member 30 set n the reversing-conveyance-path posture S4 (FIG. 7B). Accordingly, in the reversing-conveyance-path posture S4, an upstream end part (third auxiliary conveyance path) of the reversing conveyance path 104 is formed by the upper end surfaces of the guide fins 33 and the second arcuate guide plate 108*b* curved downwardly.

The pair of guide shafts 34 projecting concentrically in opposite directions from the pair of side plates 31 are supported on an unillustrated frame of the apparatus main body 11. By the driving of the posture changer 50, the rotary guide member 30 can be integrally rotated in forward and reverse directions about the centers of the guide shafts 34.

The cover body 35 is for preventing the entrance of foreign matters such as dust into the rotary guide member 30, covers an upper part of the rotary guide member 30 as shown in FIG. 3 and is mounted between the upper edges of the pair of side plates 31 in FIG. 3. At a top part of such a cover body 35, the discharge port 351 (exit) extending in forward and backward directions for the discharge of the sheet P is formed at a position facing the discharge opening 322 of the pair of arcuate guide plates 32.

A plurality of pairs of guide pulleys 40 are arranged one behind another with the pair of left and right arcuate guide plates 32 located between each pair. A pair of guide pulleys 40 are supported rotatably about a pair of left and right pulley shafts 41. The pair of pulley shafts 41 are mounted between the pair of side plates 31 at laterally outer positions of the left and right arcuate guide plates 32 while penetrating through the respective guide fins 33 (only left pulley shaft 41).

On the other hand, the left and right arcuate guide plates 32 are formed with through windows 323 as shown in FIG. 4 at positions corresponding to the respective guide pulleys 40. The respective guide pulleys 40 enter the guide path 320 between the pair of arcuate guide plates 32 through these through windows 323. In this way, the circumferential surfaces of each pair of guide pulleys 40 partly project into the guide path 320 and face each other.

Accordingly, the sheet P discharged from the fixing unit 13 passes between the circumferential surfaces of the left and right guide pulleys 40 without the image forming surface of the sheet P coming into contact with the pair of arcuate guide plates 32 while being introduced to between the pair of arcuate guide plates 32 via the receiving opening 321. At this time, even if the image forming surface of the sheet P should come into contact with the circumferential surfaces of the guide pulleys 40, the guide pulleys 40 are rotated about the pulley shafts 41 by this contact, wherefore the image forming surface of the sheet P does not come into sliding contact with the inner surfaces of the arcuate guide plates 32. Thus, the occurrence of problems such as an image disturbance caused by the sliding contact of the image forming surface of the sheet P can be effectively prevented.

The posture changer 50 is for setting the posture of the rotary guide member 30 in accordance with a control signal from a controller 200 to be described later. Such a posture changer 50 includes a stepping motor 51, a drive gear 52 concentrically and integrally rotatably fitted on a drive shaft 511 of the stepping motor 51, and a section gear 53 integrally rotatably fixed to the rear guide shaft 34 and engaged with the drive gear 52.

Since the stepping motor 51 is so constructed as to set an angle of rotation according to a pulse number of a pulse signal, the angle of rotation of the stepping motor 51, i.e. the posture of the rotary guide member 30 is highly accurately controlled by supplying a signal having a preset pulse number to the stepping motor 30 according to purpose.

Accordingly, in the case of using the stepping motor 51, the posture can be highly accurately changed and, in addition, there is no such inconvenience of generating abnormal noise as compared with the case where a guiding destination is changed by changing the posture of a specified guiding member by turning on and off power supply, for example, to a solenoid as in the prior art.

Such a stepping motor 51 is horizontally installed at a rear upper part of the rotary guide member 30 so that the drive shaft 511 extends forward. A drive force of the stepping motor 51 is transmitted to the rotary guide member 30 via the drive gear 52 and the section gear 53. Thus, the rotary guide member 30 is rotated in forward and reverse directions about the guide shafts 34 to change its posture by the stepping motor 51 being driven in forward and reverse directions.

The reference position detector 60 includes a light blocking piece 61 projecting radially outward from the section gear 53 and an optical sensor 62 arranged on a rotational path of the light blocking piece 61 about the guide shaft 34 to face the light blocking piece 61 with the rotary guide member 30 set in the reference posture S1 (FIG. 6A) as a home position.

The optical sensor 62 is a so-called photointerrupter constructed such that a light emitting element 623 and a light receiving element 624 are arranged to face each other in a forked supporting case 621 including a pair of element supporting arms 622.

The supporting case 621 is so positioned that the respective element supporting arms 622 are located at the opposite sides of the rotational path of the light blocking piece 61 and the light blocking piece 61 is located between the pair of element supporting arms 622 with the rotary guide member 30 set in the reference posture S1. The light emitting element 623 is provided in one element supporting arm 622 and the light receiving element 624 is so provided in the other element supporting arm 622 as to face the light emitting element 623. The reference posture S1 is an example of a predetermined posture.

Accordingly, unless the rotary guide member 30 is set in the reference posture S1, light emitted from the light emitting element 623 is received by the light receiving element 624 to turn the light receiving element 624 on. In this way, it can be detected that the rotary guide member 30 is not set in the reference posture S1.

On the contrary, if the rotary guide member 30 is set in the reference posture S1, the light blocking piece 61 is located between the pair of element supporting arms 622 and light from the light emitting element 623 is blocked by the light blocking piece 61, wherefore the light receiving element 624 is turned off. In this way, it can be detected that the rotary guide member 30 is set in the reference posture S1.

In other words, a signal indicating an off-state of the light receiving element 624 serves as a detection signal indicating that the rotary guide member 30 is located in the reference posture S1 (reference rotational position). The detection signal indicating that the rotary guide member 30 is located in the reference posture S1 (reference rotational position) is merely called as a detection signal below.

With a rotational position of the stepping motor 51 when the light receiving element 624 is turned off set as the reference rotational position, excitation pulses are supplied to the stepping motor 51 from this reference rotational position on, whereby the stepping motor 51 is rotated by a desired angle of rotation according to the number of the excitation pulses to set the rotary guide member 30 in a desired posture.

For example, the reference posture S1 is located at a furthest counterclockwise position out of the reference posture S1 (reference rotational position), the standing posture S2, the internal-discharge-tray posture S3 and the reversing-conveyance-path posture S4 to be described later. Accordingly, regardless of in which posture the rotary guide member 30 is set, the rotary guide member 30 is rotated to reach the reference posture S1 (reference rotational position) and turn the light receiving element 624 off if an instructing section 202 to be described later continues to output excitation pulses as an instruction signal to rotate the stepping motor 51 in such a direction as to rotate the rotary guide member 30 counterclockwise (direction toward the reference posture S1).

The instructing section 202 can set the rotary guide member 30 in the reference posture S1 by stopping the output of the excitation pulses when the light receiving element 624 is turned off.

Figure 6A:
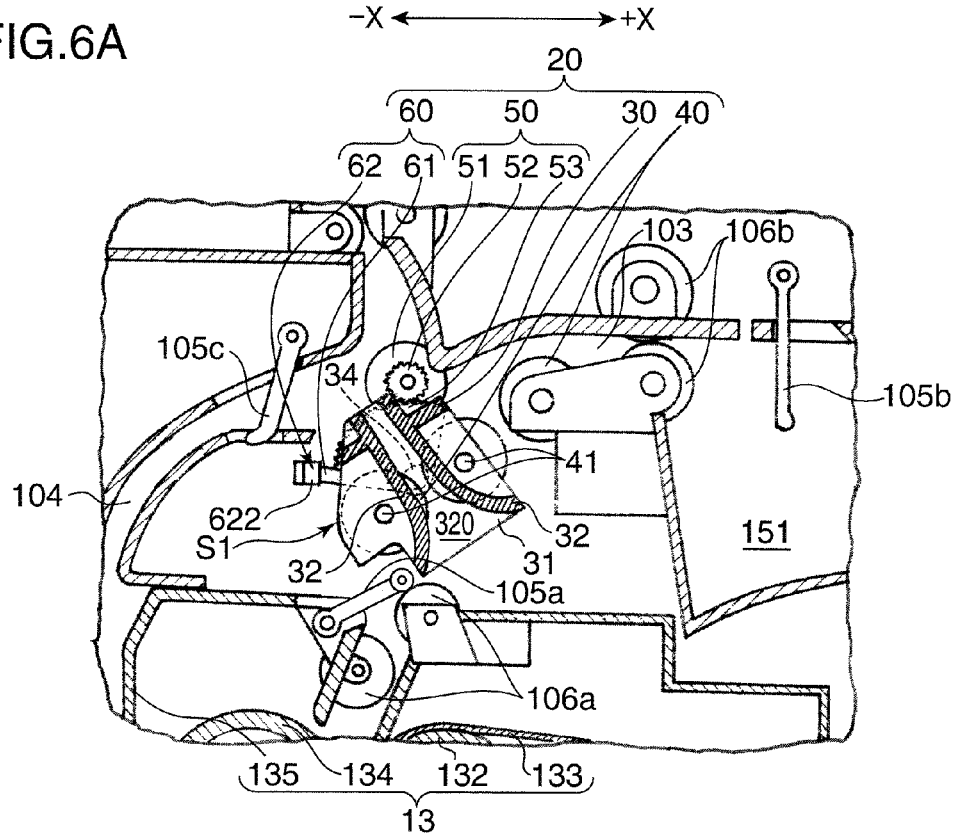
Figure 6B:
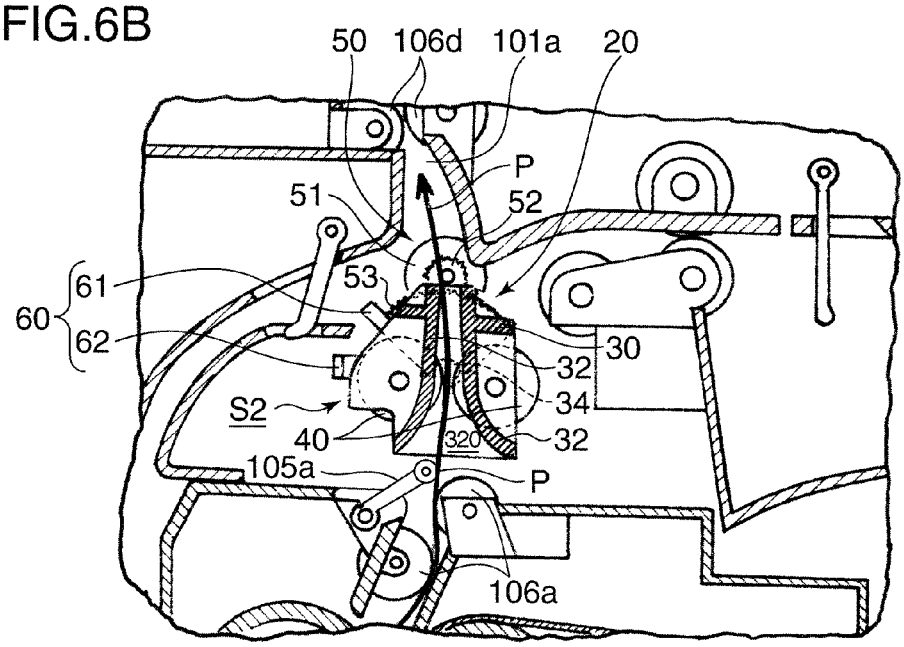

Sheet guiding postures of the rotary guide member 30 are described below with reference to FIGS. 6 and 7. FIGS. 6 and 7 are front views in section of the rotary guide member 30 showing the sheet guiding postures of the rotary guide member 30. FIG. 6A shows a state where the rotary guide member is set in the reference posture S1 and FIG. 6B shows a state where the rotary guide member 30 is set in the standing posture S2.

Figure 7A:
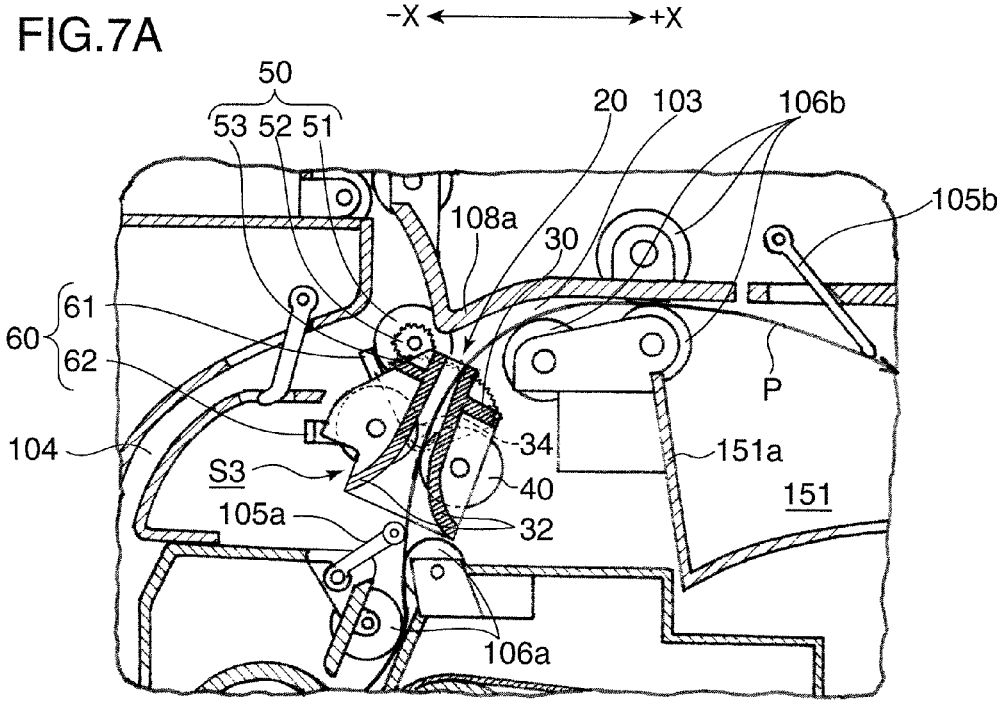
FIG. 7A shows a state where the rotary guide member is set in an oblique posture toward an internal discharge tray and FIG. 7B shows a state where the rotary guide member is set in a posture toward a reversing conveyance path.
Figure 7B:
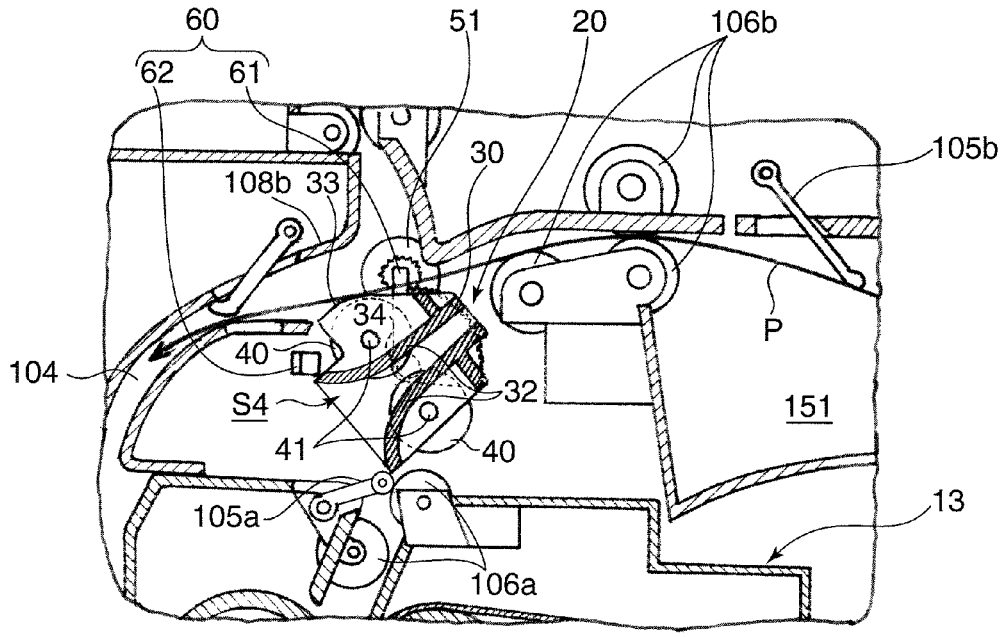

FIG. 7A shows a state where the rotary guide member 30 is set in the internal-discharge-tray posture S3 and FIG. 7B shows a state where the rotary guide member 30 is set in the reversing-conveyance-path posture S4. It should be noted that direction indication by X in FIGS. 6 and 7 is as in FIG. 1 (−X: leftward, +X: rightward).

First of all, when the rotary guide member 30 is set in the reference posture S1 as shown in FIG. 6A, the guide path 320 between the pair of arcuate guide plates 32 is rotated counterclockwise by about 30° about the guide shafts 34 from a vertical position, thereby being inclined toward the left.

In this state, the light blocking piece 61 fixed to the section gear 53 is located between the pair of element supporting arms 622 of the optical sensor 62 to block light from the light emitting element 623 (FIG. 3) so that no light is incident on the light receiving element 624. In this way, it is detected that the rotary guide member 30 is set in the reference posture S1 and the reference position of the stepping motor 51 is detected.

Further, when the rotary guide member 30 is set in the standing position S2 as shown in FIG. 6B, the discharge port 351 is so positioned as to face toward the upper-end conveyance path 101*a*. In the standing posture S2, a sheet P discharged from the fixing unit 13 is introduced into the guide path 320 of the rotary guide member 30 from the receiving opening 321 via the detection position of the fixing sensor 105*a*, passes between the pairs of guide pulleys 40 and is discharged upward toward the upper-end conveyance path 101*a* from the discharge port 351.

Thereafter, the sheet P is directly discharged to the external discharge tray 152 or discharged to the external discharge tray 152 as one of a sheet bundle after being temporarily discharged to the internal finisher 153 and post-processing such as stapling is applied.

When the rotary guide member 30 is set in the internal-discharge-tray posture S3 as shown in FIG. 7A, the discharge port 351 is so positioned as to face the discharge rollers 106*b*. In the internal-discharge-tray posture S3, the sheet P discharged from the fixing unit 13 passes along the guide path 320 of the rotary guide member 30 and is discharged to the internal discharge tray 151 while being guided by the first arcuate guide plate 108*a* after exiting from the discharge port 351. The internal-discharge-tray posture S3 is also used for switching the sheet P back to turn the sheet P upside down in the case of performing two-sided printing to the sheet P.

When the rotary guide member 30 is set in the reversing-conveyance-path posture S4 as shown in FIG. 7B, the guide fins 33 are arranged to extend between the first discharge rollers 106*b* and the reversing conveyance path 104. In this way, the sheet P conveyed in the reverse direction by the first discharge rollers 106*b* from the internal discharge tray 151 upon the switchback at the time of two-sided printing can be conveyed to the reversing conveyance path 104 by being guided by the guide fines 33.

Figure 8:
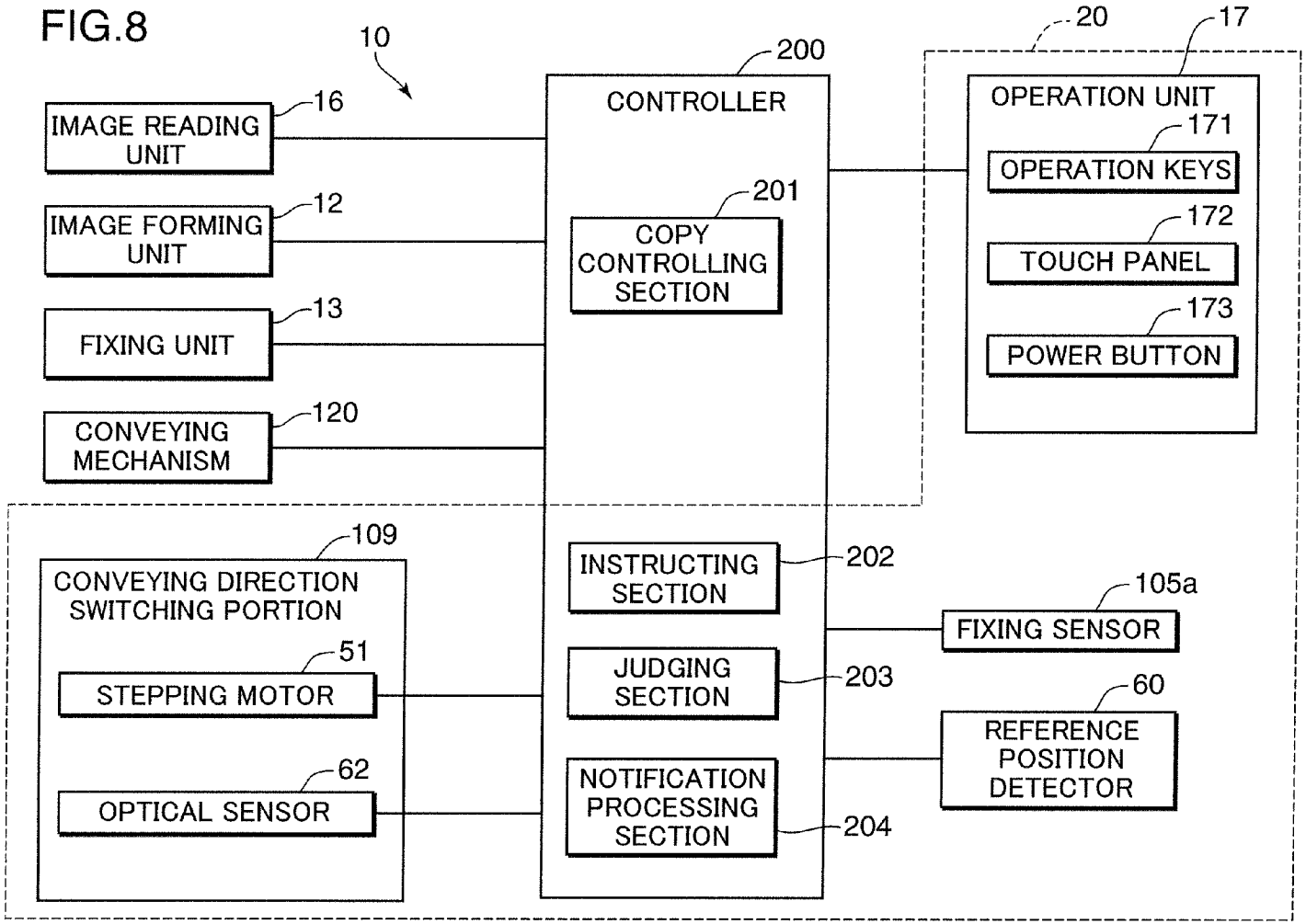
FIG. 8 is a block diagram showing an exemplary electrical construction of the image forming apparatus shown in FIG. 1.

FIG. 8 is a block diagram showing an exemplary electrical construction of the image forming apparatus 10 shown in FIG. 1. The image forming apparatus 10 includes the controller 200 in addition to the above mechanical parts. In FIG. 8, various rollers, switching guides, etc. for conveying sheets are collectively shown as a conveying mechanism 120.

The controller 200 includes a CPU (Central Processing Unit) for executing, for example, specified arithmetic processings, a ROM (Read Only Memory) storing a specified control program, a RAM (Random Access Memory) for temporarily storing data, a timer circuit, and peripheral circuits of these. The image reading unit 16, the image forming unit 12, the fixing unit 13, the conveying mechanism 120 and the operation unit 17 are connected to the controller 200.

Various sensors such as the optical sensor 62 and the fixing sensor 105*a* are also connected to the controller 200. Further, the stepping motor 51 is connected to the controller 200. The controller 200 functions as a copy controlling section 201, the instructing section 202, a judging section 203 and a notification processing section 204 (notifying section), for example, by executing the control program stored in the ROM.

The fixing sensor 105*a* is in the form of a lever. When a sheet P is discharged from the fixing unit 13 by the fixing-unit exit rollers 106*a*, the fixing sensor 105*a* is pushed up by the sheet P to be turned on, thereby detecting the sheet P. When the sheet P is further conveyed and the trailing end thereof passes beyond the position of the fixing sensor 105*a*, the fixing sensor 105*a* returns to its initial position to be turned off.

In this way, the fixing sensor 105*a* is turned on while the sheet P is present at the position of the fixing sensor 105*a*, i.e. while the sheet P discharged from the fixing unit 13 is passing the position leading to the receiving opening 321 of the guide path 320. Accordingly, a turn-on timing of the fixing sensor 105*a* indicates an entrance timing of the leading end of the sheet P into the receiving opening 321 and a turn-off timing of the fixing sensor 105*a* indicates an entrance timing of the trailing end of the sheet P into the receiving opening 321.

The fixing sensor 105*a* is not necessary a lever-type sensor and may be a sheet sensor using, for example, an optical sensor or an electrostatic sensor.

The copy controlling section 201 controls the operations of the respective parts in the apparatus to copy a document image. Specifically, the copy controlling section 201 causes the conveying mechanism 120 to convey a sheet P and transmits an image data read from a document by the image reading unit 16 to the image forming unit 12, thereby causing the image forming unit 12 to form an image on the sheet P.

The instructing section 202 is for instructing the respective parts of the image forming apparatus 10 to perform a warm-up operation when the maintenance door 19 is closed. The warm-up operation includes, for example, heating-up of the fixing roller and various units and the rotation of the photoconductive drum 121. The instructing section 202 outputs an instruction signal indicating an instruction to execute the warm-up operation and an instruction to confirm the operation of the rotary guide member 30 to the stepping motor 51.

Specifically, the instructing section 202 continues to output excitation pulses as the instruction signal for rotating the rotary guide member 30 in the counterclockwise direction, thereby rotating the stepping motor 51 to drive and rotate the rotary guide member 30. Upon receiving a detection signal from the reference position detector 60, the instructing section 202 stops outputting the instruction signal, thereby causing the rotary guide member 30 to be positioned in the reference posture S1 (reference rotational position).

In this way, the rotary guide member 30 is set in the reference posture S1 when the warm-up operation is completed.

The judging section 203 is for judging whether or not a detection signal indicating that the rotary guide member 30 is in the reference posture S1 (reference rotational position) has been received in response to the instruction signal output to the stepping motor 51 by the instructing section 202 this time.

The notification processing section 204 counts a consecutive occurrence number of a judgment result to the effect that no detection signal was output in response to the instruction signal this time if the judging section 203 judged that no detection signal was received in response to the instruction signal by the instructing section 202 this time. The notification processing section 204 judges whether or not this count value has reached, for example, "3" as a preset number and, for example, causes the LCD to visually notify the occurrence of a sheet jam, assuming that the detection signal output from the instructing section 202 this time was not received due to the sheet jam if the count value has not reached "3".

Presumable sheet jams include a sheet jam which occurs upon the collision of the leading end of a sheet P with the arcuate guide plate 32 due to a curved state of the sheet P beyond a presumable range, for example, when the sheet P from the fixing unit 13 is guided to the guide path 320 and a sheet jam which occurs upon the collision of the leading end of a sheet with the frame or the like in the apparatus due to a curved state of the sheet beyond a presumable range during the conveyance of the sheet discharged from the discharge opening 322 of the rotary guide member 30 toward the switching-guide-member conveyor rollers 106*d*. If such a sheet jam occurs, the rotation of the rotary guide member 30 is hindered.

On the other hand, the notification processing section 204 causes the LCD to visually notify the occurrence of an abnormality in the stepping motor 51 and prompt an inspection request of the image forming apparatus 10 to a service person. The form of notification is not limited to the visual one, and an auditory notification using, for example, a loudspeaker can also be adopted.

Figure 9:
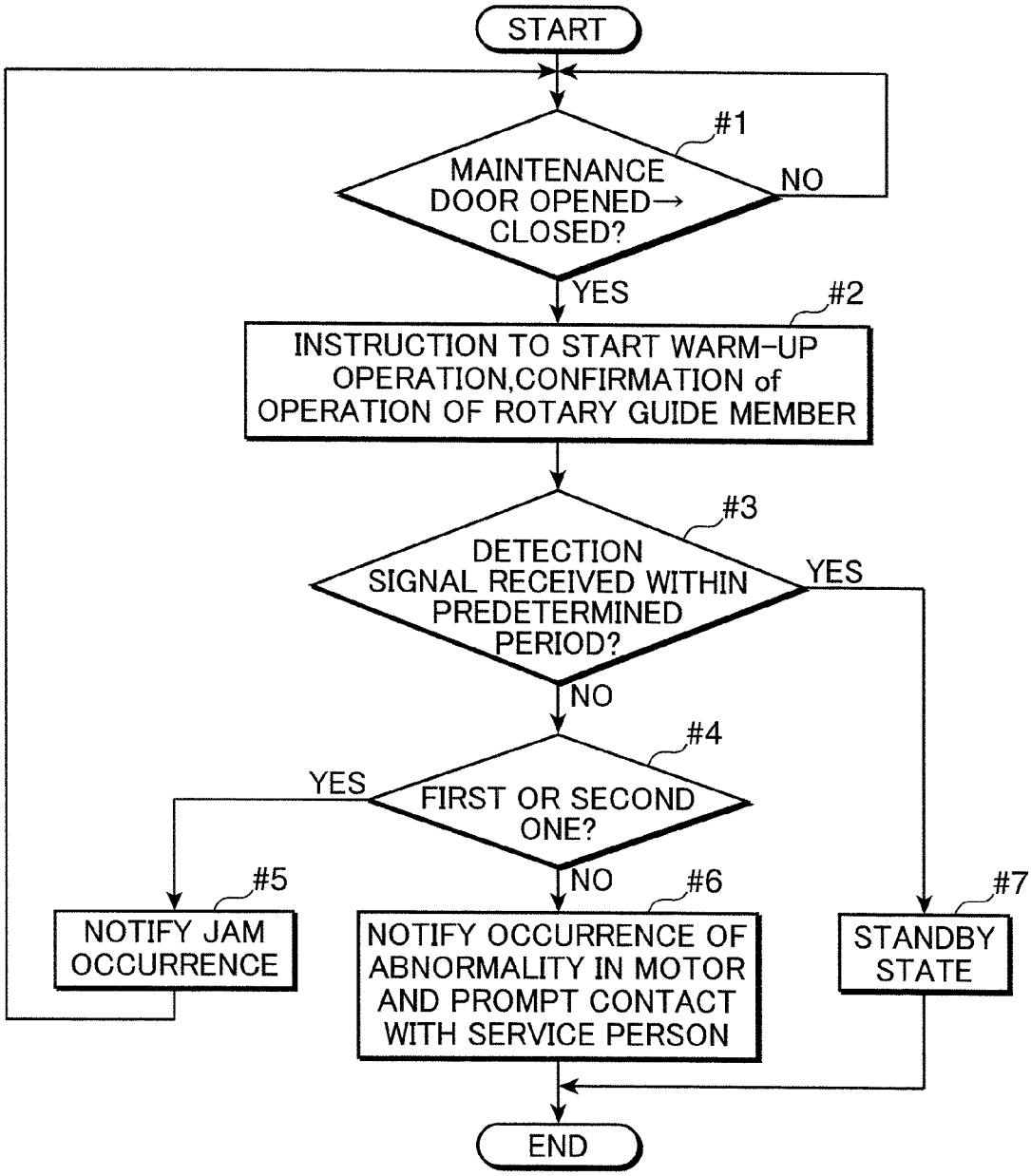
FIG. 9 is a flow chart showing an exemplary notification operation of the image forming apparatus.

Next, a series of notification operations of the image forming apparatus 10 constructed as described above are described. FIG. 9 is a flow chart showing an exemplary operation of the image forming apparatus 10 shown in FIG. 1.

First of all, as shown in FIG. 9, when the controller 200 detects that the opened maintenance door was closed (YES in Step #1), the instructing section 202 instructs the respective parts in the image forming apparatus 10 to start the warm-up operation and outputs an instruction signal indicating an instruction to confirm the operation of the rotary guide member 30, i.e. an instruction signal for rotating the rotary guide member 30 toward the reference posture S1, to the stepping motor 51 (Step #2).

Subsequently, the judging section 203 judges whether or not a detection signal indicating that the rotary guide member 30 has reached the reference rotational position has been received from the reference posture detector 60 within a preset judgment period after the start of the output of the instruction signal to the stepping motor 51 by the instructing section 202 (Step #3), and the controller 200 sets the image forming apparatus 10 in a standby state (Step #7) after the warm-up operation is completed if the detection signal is judged to have been received within the judgment period (YES in Step #3).

For example, a period necessary to rotate the rotary guide member 30 from the reversing-conveyance-path posture S4 most distant from the reference posture S1 (largest rotation amount) out of the postures, which the rotary guide member 30 can take, to the reference posture S1 by rotating the stepping motor 51 in accordance with the instruction signal is set as the judgment period.

Further, the judging section 203 initializes the count value of the consecutive occurrence number to be described later to zero in Step #7.

On the other hand, the judging section 203 counts the consecutive occurrence number of the judgment result to the effect that no detection signal was received in response to the instruction signal this time when judging that no detection signal was received from the reference posture detector 60 within the judgment period, and judges based on the count value of the consecutive occurrence number whether or not the judgment result this time to the effect that no detection signal was received in response to the instruction signal this time is the first or second one (Step #4).

At this time, if the stepping motor 51 is rotated in accordance with the instruction signal output from the instructing section 202 even once and the detection signal was output from the reference posture detector 60 within the judgment period, the count value of the consecutive occurrence number is initialized to zero in Step #7. Thus, if the count value of the consecutive occurrence number is 2 or larger, it means the consecutive occurrence of an event where no detection signal indicating the presence at the reference rotational position within the judgment period was obtained even though the instructing section 202 output the instruction signal.

If the judging section 203 judges that the judgment result this time is the first or second one (YES in Step #4), the notification processing section 204 causes, for example, the LCD to visually notify the occurrence of a sheet jam (Step #5). On the other hand, if the judging section 203 judges that the judgment result this time is neither the first nor the second one, i.e. if the judgment result this time is the third or later one (NO in Step #4), the notification processing section 204 causes, for example, the LCD to visually notify the occurrence of an abnormality in the stepping motor 51 and a message prompting an inspection request of the image forming apparatus 10 to the service person (Step #6).

The message prompting the inspection request of the image forming apparatus 10 is, for example, a message saying that "Abnormality occurred in stepping motor 51. Contact a service person to request an inspection".

As described above, in this embodiment, when the maintenance door 19 is closed, an instruction signal for locating the rotary guide member 30 at the reference rotational position is output to the stepping motor 51. If no detection signal was received from the reference posture detector 60 within the judgment period after the start of the output of the instruction signal to the stepping motor 51, the consecutive occurrence number of the judgment result to the effect that no detection signal was received in response to the instruction signal this time was counted. If the judgment result is the first or second one, the notification processing section 204 notifies the occurrence of a sheet jam. On the other hand, if the judgment result is the third or later one, the notification processing section 204 notifies the occurrence of an abnormality in the stepping motor 51 and prompts the inspection request of the image forming apparatus 10 to the service person.

In this way, a user is let to deal with abnormalities and inspection requests of the image forming apparatus 10 to the service person are avoided until the consecutive occurrence number of the judgment result to the effect that no detection signal was output in response to the instruction signal this time reaches 3. Thus, the number of notifications to the service person and the number of inspections by the service person can be reduced by as much as inspections and the like dealt with by the user himself as long as the consecutive occurrence number is equal to or below 2 as compared with a construction for giving a notification prompting the inspection request of the image forming apparatus 10 to the service person regardless of the cause of abnormality.

As a result, burdens on the service person side can be reduced more than before and the user's chances of being forced to wait on standby for the utilization of the image forming apparatus 10 until an abnormality solving operation by the service person is completed can be reduced.

The content of notification until the consecutive occurrence number of the judgment result to the effect that no detection signal was output in response to the instruction signal this time reaches the predetermined plural number (here, 3) includes the conformation of an abnormality and the occurrence of a sheet jam that can be highly probably dealt with by the user. Thus, the user can reliably confirm and deal with the abnormality.

The present invention can also be modified as follows instead of or in addition to the above embodiment.

[1] The motor for driving and rotating the rotary guide member 30 is not limited to the stepping motor 51. For example, a DC motor may be used instead of the stepping motor. In the case of using the DC motor, an instruction signal may be, for example, a current signal for rotating the DC motor in such a direction as to rotate the rotary guide member 30 toward the reference rotational position.

[2] Although the closing of the maintenance door 19 is assumed as a predetermined operation which triggers the start of the process for confirming the operation of the rotary guide member 30 in the embodiment, the present invention is not limited to this and an operation of turning on the power button 173 for turning on and off power supply to the respective parts of the image forming apparatus 10 can also be assumed as an example of such an operation.

[3] In the embodiment, the occurrence of an abnormality in the stepping motor 51 and an instruction to contact the service person to inform such an occurrence are notified when the consecutive occurrence number of the judgment result to the effect that no detection signal was output in response to the instruction signal this time is 3 or larger. A judgment reference value for the consecutive occurrence number is not limited to 3 and may be any plural number.

However, as the judgment reference value increases, the number of operations imposed on the user until the user contacts the service person to inform the abnormality (operations of opening and closing the maintenance door 19 or turning the power button 173 on and off) increases to trouble the user. On the other hand, if the judgment reference value is set at 2, there is a high possibility that the user opens and closes the maintenance door 19 or turns the power button 173 on and off without reliably checking a sheet jam when the occurrence of the sheet jam is notified for the first time.

Accordingly, in the embodiment, the judgment reference value is set at 3 which is most preferable in terms of a balance between a reduction in the number of contacts with the service person and time and effort caused by the operations imposed on the user.

[4] When the consecutive occurrence number of the judgment result to the effect that no detection signal was output in response to the instruction signal this time reaches 3, both the notification informing the occurrence of an abnormality in the stepping motor 51 and the notification prompting the inspection request of the image forming apparatus 10 to the service person are given. However, either one of the notification prompting the inspection request of the image forming apparatus 10 to the service person and the notification leading to prompting of the inspection request of the image forming apparatus 10 to the service person may be given.

[5] Although the copier is adopted as the image forming apparatus 10, the image forming apparatus 10 may be a printer or a facsimile machine without being limited to the copier.

That is to say, an image forming apparatus according to one aspect of the present invention comprises a rotary guide member including a guide path capable of permitting the passage of a sheet being conveyed and rotatable about a supporting shaft extending in a direction orthogonal to a conveying direction to change the posture thereof in such a manner that the exit of the guide path faces toward any one of at least two conveyance destinations; a motor for changing the posture of the rotary guide member; a detector for outputting a detection signal when a predetermined posture of the rotary guide member is detected; an instructing section for outputting an instruction signal to the motor to operate the rotary guide member toward the predetermined posture when a predetermined operation which triggers the start of a process for confirming the operation of the rotary guide member using the detector is performed to the image forming apparatus; a judging section for judging whether or not the detection signal has been received from the detector in response to the instruction signal by the instructing section this time; and a notifying section for counting a consecutive occurrence number of a judgment result to the effect that no detection signal was received in response to the instruction signal this time when the judging section judged that no detection signal was received in response to the instruction signal this time and giving at least one of a notification prompting an inspection request of the image forming apparatus and a notification relating to prompting of the inspection request when the consecutive occurrence number reaches a set plural number.

According to this construction, when the predetermined operation is performed, the instruction signal for operating the rotary guide member is output to the motor by the instructing section and the operation of the rotary guide member is confirmed using the detector. Then, whether or not a detection signal has been received from the detector in response to the instruction signal by the instructing section this time is judged by the judging section.

Here, when the judging section judged that no detection signal was received in response to the instruction signal by the instructing section this time, the notifying section counts the consecutive occurrence number of the judgment result to the effect that no detection signal was received in response to the instruction signal this time and gives at least one of the notification prompting the inspection request of the image forming apparatus to a service person and the notification relating to prompting of the inspection request.

In this way, the inspection request of the image forming apparatus to the service person by the user is avoided until the consecutive occurrence number of the judgment result to the effect that no detection signal was received in response to the instruction signal this time reaches the set number.

As a result, the number of notifications to the service person can be reduced by as much as inspections and the like dealt with by the user himself as compared with a construction for giving a notification prompting the inspection request of the image forming apparatus to the service person regardless of the cause of an abnormality.

The notifying section preferably assumes the occurrence of a sheet jam and gives a corresponding notification until the consecutive occurrence number reaches the set number after the first judgment by the judging section that no detection signal was received in response to the instruction signal this time.

According to this construction, the occurrence of the sheet jam that can be dealt with by the user himself is assumed and the corresponding notification is given until the consecutive occurrence number reaches the set number after the first judgment by the judging section that no detection signal was received in response to the instruction signal this time. Thus, the user can be let to confirm and deal with abnormalities as much as possible until the consecutive occurrence number reaches the set plural number.

An operation of closing an opening door for exposing the interior of the image forming apparatus and an operation of turning on a power button to supply power necessary for respective parts of the image forming apparatus are presumed as examples of the predetermined operation that triggers the start of the process for setting the rotary guide member in the predetermined posture.

The consecutive occurrence number (set number) is preferably set at 3 in view of a balance between a reduction in the number of notifications to the service person (number of operations) and time and effort of the user (time and effort resulting from the operation of opening and closing the opening door or turning the power button on and off until the notification of the occurrence of a trouble disappears).

Further, the judging section preferably judges that no detection signal was received in response to the instruction signal this time when no detection signal was output from the detector within a judgment period set beforehand after the output of the instruction signal by the instructing section was started.

Since the posture of the rotary guide member is not known when the output of the instruction signal by the instructing section is started, a period required for the rotary guide member to reach the predetermined posture after the start of the instruction signal is unknown even when the rotary guide member normally operates. Accordingly, a maximum period presumed as a period required for the rotary guide member to reach the predetermined posture after the start of the driving of the rotary guide member is, for example, set as the judgment period beforehand. If it is judged that no detection signal was received from the detector in response to the instruction signal when no detection signal was output from the detector within the judgment period after the output of the instruction signal by the instructing section was started, accuracy in judging an inoperative state of the rotary guide member is increased.

The rotary guide member further includes a guide pulley which freely rotates about a shaft parallel with the supporting shaft and a part of which projects into the guide path.

According to this construction, a sheet is permitted to smoothly pass along the guide path by the guide pulley.

It is preferable that a pair of the guide pulleys are provided and that parts of one and the other guide pulleys project into the guide path with the circumferential surfaces thereof facing each other.

According to this construction, a sheet guided into the guide path of the rotary guide member is moved by the free rotation of the guide pulleys due to the contact with the circumferential surfaces of the guide pulleys without an image forming surface of the sheet coming into contact with the inner wall surface of the guide path during the movement in the guide path. Thus, the image forming surface of the sheet is not rubbed against the inner wall surface of the guide path, whereby the occurrence of an image formation failure can be suppressed.

It is preferable that the guide path is formed by a pair of guide plates arranged to face at a distance and that one end opening between the guide plates facing each other serves as an entrance for the sheet and the other end opening serves as an exit for the sheet.

According to this construction, the guide path including the entrance and the exit can be easily formed.

It is preferable that at least one guide plate has an arcuate surface along an extending direction of the guide path and that the entrance end opening is made wider than the exit end opening by the arcuate surface.

According to this construction, the sheet can be better received into the entrance side.

It is preferable that the image forming apparatus further comprises an image forming unit for forming an image on the sheet, a first discharge tray as a first discharge destination of the sheet, a second discharge tray as a second discharge destination different from the first discharge destination, a main conveyance path for conveying the sheet via the image forming unit and an auxiliary conveyance path provided downstream of the main conveyance path and including a first auxiliary conveyance path for conveying the sheet to the first discharge tray and a second auxiliary conveyance path for conveying the sheet to the second discharge tray; and that the rotary guide member is provided between the main conveyance path and the auxiliary conveyance path for switching the sheet conveying direction with the first auxiliary conveyance path and the second auxiliary conveyance path as conveyance destinations.

According to this construction, the discharge of the sheet to the first discharge tray or to the second discharge tray can be easily and properly switched by the action of the rotary guide member.

It is preferable that the image forming apparatus further comprises, for two-sided printing, a reversing conveyance path for conveying the sheet in a reverse direction to a side of the main conveyance path upstream of the image forming unit and a switchback portion arranged downstream of the rotary guide member for switching the sheet back to feed the sheet to the reversing conveyance path; and that the auxiliary conveyance path further includes a third auxiliary conveyance path for conveying the sheet to the switchback portion.

According to this construction, the sheet can be accurately conveyed not only to the first discharge tray or the second discharge tray, but also to the reversing conveyance path for two-sided printing.

According to the above constructions, since the number of notifications to the service person can be reduced more than before, burdens on the service person side can be reduced and the user's chances of being forced to wait on standby for the utilization of the image forming apparatus until a trouble is solved by the service person can be reduced.

This application is based on Japanese patent application NO. 2009-138179, filed in Japan Patent Office on Jun. 9, 2009, the contents of which are hereby incorporated by reference.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. An image forming apparatus, comprising:

a rotary guide member including a guide path capable of permitting the passage of a sheet being conveyed and rotatable about a supporting shaft extending in a direction orthogonal to a conveying direction to change the posture thereof in such a manner that the exit of the guide path faces toward any one of at least two conveyance destinations;

a motor for changing the posture of the rotary guide member;

a detector for outputting a detection signal when a predetermined posture of the rotary guide member is detected;

an instructing section for outputting an instruction signal to the motor to operate the rotary guide member toward the predetermined posture when a predetermined operation which triggers the start of a process for confirming the operation of the rotary guide member using the detector is performed to the image forming apparatus;

a judging section for judging whether or not the detection signal has been received from the detector in response to the instruction signal by the instructing section this time; and a notifying section for counting a consecutive occurrence number of a judgment result to the effect that no detection signal was received in response to the instruction signal this time when the judging section judged that no detection signal was received in response to the instruction signal this time and giving a notification instructing that an inspection request be made of the image forming apparatus when the consecutive occurrence number reaches a set plural number, wherein the notifying section assumes the occurrence of a sheet jam and gives a corresponding notification until the consecutive occurrence number reaches the set number after the first judgment by the judging section that no detection signal was received in response to the instruction signal this time.

2. An image forming apparatus according to claim 1, further comprising an opening door for exposing the interior of the image forming apparatus, wherein the predetermined operation is an operation of closing the opening door.

3. An image forming apparatus according to claim 1, further comprising a power button for turning on and off power supply to respective parts of the image forming apparatus, wherein the predetermined operation is an operation of turning the power button on for the power supply.

4. An image forming apparatus according to claim 1, wherein the set number is 3.

5. An image forming apparatus according to claim 1, wherein the judging section judges that no detection signal was received in response to the instruction signal this time when no detection signal was output from the detector within a judgment period set beforehand after the output of the instruction signal by the instructing section was started.

6. An image forming apparatus according to claim 1, further comprising:

a pair of guide plates arranged to face each other at a distance from one another to form the guide path therebetween, and wherein one end opening between the guide plates facing each other serves as an entrance for the sheet and the other end opening serves as an exit for the sheet.

7. An image forming apparatus according to claim 6, wherein:

at least one of the pair of guide plates has an arcuate surface along an extending direction of the guide path, and the entrance end opening is made wider than the exit end opening by the arcuate surface.

8. An image forming apparatus according to claim 1, further comprising:

an image forming unit for forming an image on the sheet, a first discharge tray as a first discharge destination of the sheet and a second discharge tray as a second discharge destination different from the first discharge destination, a main conveyance path for conveying the sheet via the image forming unit, and an auxiliary conveyance path provided downstream of the main conveyance path and including a first auxiliary conveyance path for conveying the sheet to the first discharge tray and a second auxiliary conveyance path for conveying the sheet to the second discharge tray;

wherein the rotary guide member is provided between the main conveyance path and the auxiliary conveyance path for switching the sheet conveying direction with the first auxiliary conveyance path and the second auxiliary conveyance path as conveyance destinations.

9. An image forming apparatus according to claim 8, further comprising, for two-sided printing:

a reversing conveyance path for conveying the sheet in a reverse direction to a side of the main conveyance path upstream of the image forming unit, and a switchback portion arranged downstream of the rotary guide member for switching the sheet back to feed the sheet to the reversing conveyance path.

* * * * *